US005554275A

United States Patent [19]

Harandi

[11] Patent Number: 5,554,275

[45] Date of Patent: Sep. 10, 1996

[54] CATALYTIC HYDRODESULFURIZATION AND STRIPPING OF HYDROCARBON LIQUID

[75] Inventor: Mohsen N. Harandi, Langhorne, Pa.

[73] Assignee: Mobil Oil Corporation, Fairfax, Va.

[21] Appl. No.: 345,666

[22] Filed: Nov. 28, 1994

[51] Int. Cl.[6] ..... C10G 45/06; C10G 45/36

[52] U.S. Cl. ..... 208/213; 208/89; 208/92; 208/216 R; 208/217; 208/264

[58] Field of Search ..... 208/213, 216 R, 208/217, 264, 313, 89, 97, 99, 92

[56] References Cited

U.S. PATENT DOCUMENTS 5,073,236 12/1991 Gelbein et al. ..... 203/29
5,087,780 2/1992 Arganbright ..... 585/259
5,118,872 6/1992 Smith, Jr. et al. ..... 568/697
5,321,163 6/1994 Hickey et al. ..... 568/59

*Primary Examiner*—Asok Pal
*Assistant Examiner*—Bekir L. Yildirim
*Attorney, Agent, or Firm*—Ronald A. Bleeker; Malcolm D. Keen

[57] ABSTRACT

A method and operating technique for treating organosulfur compound-containing aliphatic streams by introducing the light hydrocarbon stream at a top portion of a vertical stripping tower having an upper catalytic contact zone containing a bed of solid hydrodesulfurization catalyst particles and a lower contact zone, and introducing a light gas stream containing hydrogen at a lower portion of said stripping tower. Hydrodesulfurization is effected by flowing the light hydrocarbon stream and light gas stream countercurrently in contact with the solid hydrodesulfurization catalyst particles under hydrodesulfurization and stripping conditions, thereby converting the organosulfur compound in the upper contact zone.

9 Claims, 1 Drawing Sheet

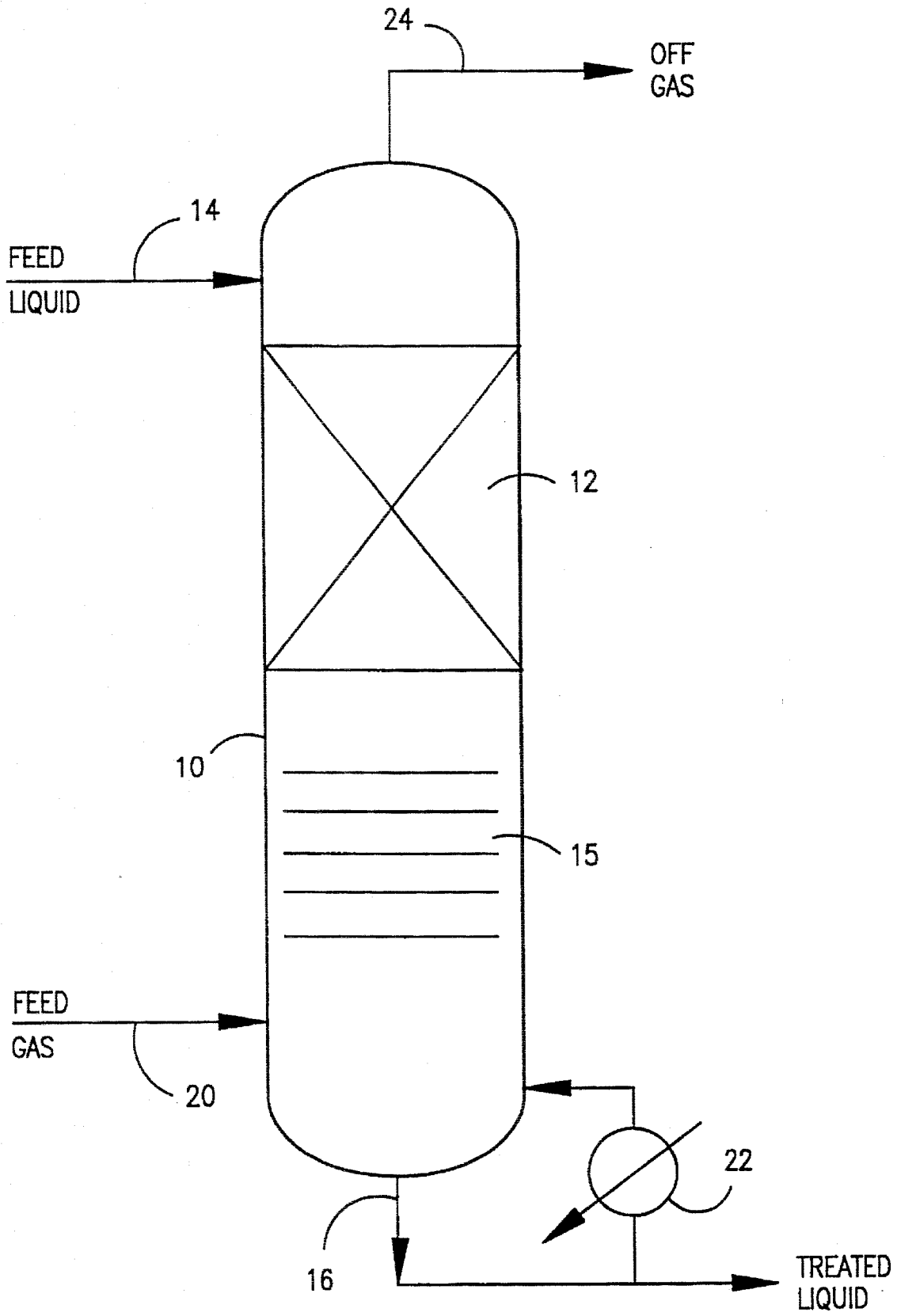
24
OFF
GAS
14
FEED
LIQUID
12
10
15
FEED
GAS
20
22
16
TREATED
LIQUID

CATALYTIC HYDRODESULFURIZATION AND STRIPPING OF HYDROCARBON LIQUID

BACKGROUND OF THE INVENTION

This invention relates to treatment of volatile hydrocarbon streams to convert sulfur-containing compounds and strip lower molecular weight components. In particular it relates to simultaneous stripping and catalytic hydrodesulfurization of $C_3$+ aliphatics to provide a treated light olefinic liquid useful for alkylation, etherification or other downstream processes.

Prior processes have required a separate selective hydrodesulfurization step to remove reactive organosulfur compounds, such as thiophenes. Volatile feedstreams also contain lower alkanes and alkenes, such as ethene, ethane, methane, H2S and impurities which are removed in a separate stripping tower.

It has been discovered that catalytic hydrodesulfurization and stripping may be conducted simultaneously in a contact tower.

SUMMARY OF THE INVENTION

An improved process has been found for hydrogenating and stripping a volatile light hydrocarbon liquid stream containing $C_3$+ aliphatics including at least one sulfur compound to remove lower boiling components and convert the organosulfur compound, thus producing hydrogen sulfide which can be stripped. The improvement comprises: a) introducing the light hydrocarbon stream, such as $C_3$–$C_5$ mixed aliphatics, at a top portion of a vertical stripping section, such as a deethanizer tower, having an upper contact zone containing a catalyst bed of solid hydrodesulfurization catalyst particles and a lower contact zone or further stripping section; b) introducing a light gas stream containing hydrogen at a lower portion of the stripping tower below the catalyst bed; c) flowing the light hydrocarbon stream and light gas stream countercurrently in contact with the solid hydrodesulfurization catalyst particles under hydrodesulfurization and stripping conditions, thereby converting the organosulfur compound in the upper contact zone; d) recovering a stripped liquid hydrocarbon stream from the bottom of said stripping tower; and e) recovering a light stripping gas stream from the top of the tower.

In the preferred embodiments the hydrodesulfurization catalyst comprises metal, such as cobalt, molybdenum, nickel, etc., on an inert solid substrate, such as Co/Mo on alumina; however, shape selective acid catalysts, such as zeolites may be employed. The process is particularly useful for treating light hydrocarbon streams containing propene, butenes, pentenes and/or dienes. Typically, the feedstream liquid comprises FCC crackate or light coker liquid, which contains a $C_2$ volatile component, such as ethene, which is removed from $C_3$+ liquid components. Heavier feedstocks containing $C_4$–$C_{15}$ hydrocarbons may be employed within the inventive concept.

The catalyst bed is advantageously maintained at an average temperature of 40° C. to 290° C. and total tower pressure is maintained at 700 to 5000 kPa, preferably 1000 to 3000 kPa.

DESCRIPTION OF THE DRAWING

FIG. 1 of the drawing is a schematic process flowsheet depicting the present invention.

DETAILED DESCRIPTION OF THE INVENTION

Countercurrent processes for contacting reactant fluids have several advantages. In a single point gas entry system, as the reactant gas rises upwardly from its point of introduction at the bottom of a vertical reactor below the porous bed, it contacts a lower concentration of reactive liquid components. At the point of entry the reactant gas has its greatest concentration. Depletion of the gaseous reactant upwardly will increase the relative concentration of inerts and/or byproduct vapors. Likewise, the liquid being treated is generally more reactive at the lower end of the reactor system where it contacts the higher temperature catalyst at high concentration of non-volatile components. Thus, the reactant concentration gradients for countercurrent two-phase systems are opposing. In a typical multi-phase reactor system, the average gas-liquid weight ratio in the catalyst zone is about 0.001:1 to 0.1:1 under process conditions.

In those reactions wherein the volume of gas decreases due to reactant depletion, the volumetric ratio or liquid to gas can increase markedly as the liquid feedstock gravitates downwardly through the reactor. In general, the reactions described herein to not change the volumetric flow of the liquid and vapor by more than about 20%.

Advantageously, the multi-phase reactor system is operated to achieve uniform distribution. If too little liquid flux is maintained, the catalyst surface in the porous bed will be coated with a liquid film; however, this trickle mode will permit excessive channeling of the gas phase instead of the desired dispersion characteristics of a reactant froth. Flow rates for both reactant phases are controlled within constraints.

In order to maintain a desirable uniform flow of reactant streams through the fixed catalyst bed, adequate flow paths for liquid and gaseous phases must be provided. In a continuous process the ratio of reactant gas to liquid feedstock and the space velocity of reactants relative to catalyst must be carefully considered. Achievement of uniform vertical flow through a porous bed of solids can be obtained if the catalyst is properly distributed and shaped. The void volume in a reaction zone is a function of catalyst configuration and loading technique. While a densely packed bed of spherical solids may be employed to place a maximum amount of catalyst in a predetermined reactor volume, the low void fraction may interfere with fluid flow, especially where countercurrent flow of two phases is required. Advantageously, the catalyst bed has a high void volume, typically greater than one half of the bed. Void fractions from 0.5 to 0.9 can be achieved using loosely packed polylobal or cylindrical extrudates. Hollow ring-type supported catalysts, such as Raschig rings or the like, permit liquids to flow downwardly through the porous bed by gravity while the gas phase reactant rises through the denser liquid, forming dispersed bubbles which contact the wetted catalyst to enhance mass transfer and catalytic phenomena.

Catalyst size can vary widely within the inventive concept, depending upon process conditions and reactor structure. If a low space velocity or long residence in the catalytic reaction zone is permissible, small catalysts having an average maximum dimension of 1 to 5 mm may be employed. However, it is preferred to use larger sizes, e.g., 0.5–2 cm or more, especially when extrudates, rings, saddles or other contact materials are desired. Relatively small catalyst particles may be loaded randomly to assure uniformity and larger supported catalysts may be stacked in a geometric pattern to achieve optimum bed utilization.

Reactor configuration is an important consideration in the design of a continuously operating system. In its simplest form, a vertical cylindrical pressure vessel is provided with a catalyst retaining means and operatively connected for countercurrent fluid flow. A typical vertical reactor having a catalyst bed length to effective diameter (L:D) ratio of about 1:1 to 20:1 is preferred. A single bed or a stacked series of beds may be retained within the same reactor shell. While a reactor of uniform horizontal cross section is disclosed herein, other non-uniform configurations, such as spherical reactors, tapered vessels, etc. may be employed.

Referring to FIG. 1, a countercurrent continuous catalytic reactor system and deethanizer tower is shown for treating a liquid phase with a gaseous reactant for selective catalytic hydrodesulfurization of organosulfur compound and stripping of volatile components. An enclosed stripping tower or reactor shell 10 contains a fixed porous bed 12 of solid catalyst in an upper contact portion. Upper liquid inlet means 14 is provided for introducing a stream of liquid substantially above the catalyst bed for downward gravity flow through the bed toward lower contact portion 15 and liquid outlet means 16 for withdrawing treated liquid from the reactor shell. Stripping may be facilitated by passing a portion of the bottom liquid stream through reboiler heat exchanger 22. Gas inlet means 20 is disposed below the catalyst bed and lower contact portion for introducing a gaseous reactant stream containing hydrogen under pressure for countercurrently contacting downwardly flowing liquid in a mixed phase reaction zone, whereby gaseous reactant is dispersed through the liquid phase in intimate contact with the solid catalyst. The stripping zone 15 may include a number of contact plates, packed column section or the like for providing necessary contact between gas and liquid phases. After passing through the stripping and reaction zones, the gas phase is recovered through upper off gas outlet means 24, and gas containing stripped volatile components is withdrawn from the tower.

Selective hydrodesulfurization is a known catalytic process for converting organosulfur compounds, and suitable catalysts are commercially available for this purpose. Hydrodesulfurization catalysts, such as Co-Mo or other metal catalysts may be employed. Zeolites, such as ZSM-5, ZSM-12 and/or MCM-22 may be employed with suitable metal functions to achieve both hydrodesulfurization and olefin oligomerization in the same catalytic reaction zone. Other hydrogenation reactions, such as hydrogenation of dienes may be conducted in the reactor system.

As an example of typical feedstock and process conditions, FCC crackate containing predominantly $C_3$–$C_5$ alkenes, alkanes and organosulfur compounds and $C_2$– volatile components is treated with a hydrogen-rich stripping gas, such as a refinery wet gas stream, in the above-described reactor tower in a solid Co-Mo/alumina packed catalyst bed under selective hydrodesulfurization conditions, preferably at 80° C. to 290° C. average reaction temperature and preferably 1000 to 3000 Kpa total pressure. The sulfur compounds are hydrogenated and treated liquid product is recovered substantially free of $C_2$– volatile components.

While the invention has been described by particular example, there is no intention to limit the inventive concept except as set forth in the following claims.

I claim:

1. A process for hydrogenating and stripping a volatile light hydrocarbon liquid stream containing $C_3$+ aliphatics including organosulfur impurity to remove lower boiling components and convert said organosulfur to monoalkene, comprising the steps of:

introducing said light hydrocarbon stream at a top portion of a vertical stripping tower having an upper contact zone containing a bed of solid hydrodesulfurization catalyst particles and a lower contact zone;

introducing a light gas stream containing hydrogen at a lower portion of said stripping tower;

flowing said light hydrocarbon stream and said light gas stream countercurrently in contact with said solid hydrodesulfurization catalyst particles under hydrodesulfurization and stripping conditions, thereby converting said organosulfur impurity in the upper contact zone;

recovering a stripped liquid hydrocarbon stream from the bottom of said stripping tower; and recovering a light stripping gas stream from the top of said tower.

2. The process of claim 1 wherein said hydrodesulfurization catalyst comprises a cobalt and/or molybdenum on an inert solid substrate.

3. The process of claim 2 wherein said catalyst comprises Co-Mo on alumina.

4. The process of claim 1 wherein said light hydrocarbon stream contains propene, butenes, pentenes and diene.

5. The process of claim 4 wherein the catalyst bed in the upper contact zone is maintained at average temperature of 80° C. to 290° C. and total tower pressure is maintained at 1000 to 3,000 Kpa.

6. The process of claim 4 wherein said light hydrocarbon stream contains a $C_2$ volatile component, which is removed from $C_3$+ liquid components.

7. The process of claim 1 wherein said light hydrocarbon stream comprises sulfur-containing FCC crackate or light coker liquid.

8. In the process for stripping and de-ethanizing a light FCC crackate stream containing a mixture of $C_2^-$ and $C_3^+$ alkene components and including organosulfur compound components, wherein the crackate stream is stripped in a deethanizer tower to remove $C_2^-$ components from the crackate stream; the improvement which comprises:

contacting the crackate in liquid downflow with a countercurrent hydrogen-containing gas stream in a fixed bed of solid catalyst particles maintained in the deethanizer tower, wherein the catalyst particles comprise hydrodesulfurization metal for converting organosulfur compound.

9. In the process of claim 8, wherein the hydrodesulfurization catalyst comprises a Co-Mo metal on a solid catalyst carrier, wherein the bed of catalyst is maintained at average bed temperature up to 290° C., and wherein the crackate stream contains thiophene.

* * * * *